US006935901B2

(12) United States Patent
Simpson et al.

(10) Patent No.: US 6,935,901 B2
(45) Date of Patent: Aug. 30, 2005

(54) SELF-CLEANING CONNECTOR

(75) Inventors: Russell L. Simpson, Miami, FL (US); Sybren D. Smith, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/670,024

(22) Filed: Sep. 24, 2003

(65) Prior Publication Data

US 2005/0064765 A1 Mar. 24, 2005

(51) Int. Cl.[7] ..... H01R 13/24
(52) U.S. Cl. ..... 439/700
(58) Field of Search ..... 439/288, 287, 439/289, 700, 824

(56) References Cited

U.S. PATENT DOCUMENTS 5,158,468 A * 10/1992 Curtis et al. ..... 439/76.1
5,259,769 A * 11/1993 Cruise et al. ..... 439/65
5,540,599 A * 7/1996 Bishop ..... 439/289
5,584,713 A * 12/1996 Kato et al. ..... 439/188
5,716,230 A * 2/1998 Marren et al. ..... 439/500
6,241,537 B1 * 6/2001 Tate et al. ..... 439/108
6,283,777 B1 * 9/2001 Canova et al. ..... 439/218
6,315,576 B1 * 11/2001 Neidich ..... 439/66

* cited by examiner

*Primary Examiner*—J. F. Duverne
(74) *Attorney, Agent, or Firm*—Larry G. Brown

(57) ABSTRACT

The invention concerns a connector (110). The connector includes at least one tunnel (124) having a first portion (126) and a second portion (128) and at least one pin (120). At least a portion of the pin is positioned within the tunnel. The first portion of the tunnel has a first inner surface (140). The first inner surface forces at least a portion of the pin in at least a first predetermined direction as the connector engages a corresponding connector (112). Contaminants are at least partially removed from at least one of the pin and the corresponding connector as the first inner surface forces the pin in the first predetermined direction.

20 Claims, 4 Drawing Sheets

SELF-CLEANING CONNECTOR

BACKGROUND

1. Technical Field

This invention relates in general to connectors and more particularly, to electrical connectors that couple accessories to an electronic device.

2. Description of the Related Art

Many electronic devices include electrical connectors that can be used to couple accessories to such devices. For example, most cellular telephones include a connector that can receive and engage a corresponding connector of a charger. The connector of the charger typically includes a set of pins and the connector of the mobile unit has a set of corresponding electrical contacts. When the charger connector is inserted in the connector of the mobile unit, the pins of the charger connector contact the contacts of the telephone connector, which can permit the charger to provide a charging current to the battery of the mobile unit.

The pins of the charger connector and the contacts of the mobile unit connector, however, are typically exposed to the outside environment. As such, dirt or other contaminants may collect on either the pins of the charger connector or the contacts of the cellular telephone connector. If either of these components is contaminated in such a fashion, the electrical connection between them suffers, which can cause a degradation in the performance of the charger. This drawback is not limited to chargers, however, as the pins and contacts in virtually any type of connector are susceptible to such contamination.

SUMMARY OF THE INVENTION

The present invention concerns a connector. The connector includes at least one tunnel having a first portion and a second portion and at least one pin in which at least a portion of the pin is positioned within the tunnel. The first portion of the tunnel has a first inner surface that forces at least a portion of the pin in at least a first predetermined direction as the connector is engaged with a corresponding connector. Contaminants are at least partially removed from at least one of said pin and the corresponding connector as said first inner surface forces said pin in said first predetermined direction. The first inner surface can run along an axis that is at a predetermined angle with respect to a vertical axis of the tunnel.

In one arrangement, the pin can include a contact surface that can contact a contact of the corresponding connector. Further, the first inner surface forcing the pin in the first predetermined direction can cause the contact surface to slide against the contact of the corresponding connector. The contaminants on at least one of the pin and the contact of the corresponding connector can be at least partially removed from at least one of the pin and the contact of the corresponding connector as the contact slides against the contact of the corresponding connector.

In another arrangement, the pin can include an elongated portion, a fork and a spring. As an example, the elongated portion can be attached to the spring, and the spring can be attached to the fork. As another example, the elongated portion can extend from the spring along an axis at a predetermined angle with respect to a vertical axis of the pin. This predetermined angle of the axis that the elongated portion runs along can at least substantially match the predetermined angle of the axis that the first inner surface runs along.

In yet another embodiment of the invention, the first portion of the tunnel can further include a second inner surface opposed to the first inner surface. The second inner surface can run along an axis that is at a predetermined angle that can at least substantially match the predetermined angle of the axis that the first inner surface runs along. The second inner surface can force the pin in a second predetermined direction as the connector disengages the corresponding connector. As an example, the second predetermined direction is at least substantially opposite to the first predetermined direction.

The first portion can house the elongated portion of the pin, and the second portion can house the spring of the pin. Also, the connector can include a body in which the body can include a plurality of the tunnels, and at least a portion of the pins can extend beyond the tunnels. The body can include a head that can fit at least substantially within the corresponding connector. As another example, the connector can be an accessory connector, and the corresponding connector can be mounted on an electronic device.

In another arrangement, the pin can include an elongated portion, a fork and a spring. The elongated portion can be attached to the spring, and the spring can be attached to the fork in which at least a portion of the elongated portion can be curved. Also, the elongated portion can have a segment that can run along an axis that is at a predetermined angle with respect to a horizontal axis of the pin. The segment can be attached to the curved portion of the elongated portion and the spring.

The first predetermined direction can be a curved direction that can run along an arc thereby causing the contact surface of the pin to slidably rotate against the contact of the corresponding connector. As such, the contaminants on at least one of the pin and the contact of the corresponding connector are at least partially removed from at least one of the pin and the contact of the corresponding connector as the contact surface slidably rotates against the contact of the corresponding connector.

The first portion of the tunnel can further include a second inner surface opposed to the first inner surface in which the first inner surface and the second inner surface can be curved. The shape of the first inner surface and the second inner surface can substantially match the curved portion of the elongated portion. In addition, the second inner surface, in combination with the first inner surface, can force the pin in the first predetermined direction. In yet another arrangement, the first inner surface and the second inner surface can force the pin in a second predetermined direction in which the second predetermined direction can be a curved direction that is opposite that of the first predetermined direction. The second predetermined direction can cause the contact surface of the pin to slidably rotate against the contact of the corresponding connector.

The present invention also concerns a system for cleaning contacts of corresponding connectors. The system can include a first connector and a second connector. The first connector can include at least one tunnel having a first portion and a second portion and at least one pin in which at least a portion of the pin can be positioned within the tunnel. The first portion of the tunnel can have a first inner surface, and the first inner surface can force at least a portion of the pin in a predetermined direction as the first connector is engaged with the second connector. Contaminants on at least one of the pin and the second connector can be at least partially removed from at least one of the pin and the second connector as the first inner surface forces the pin in the predetermined direction.

The first inner surface can run along an axis that is at a predetermined angle with respect to a vertical axis of the tunnel. The pin can include a contact surface that can contact a contact of the second connector. In one arrangement, the first inner surface forcing the pin in the predetermined direction can cause the contact surface to slide against the contact of the second connector.

The tunnel can further include a second inner surface, and the pin can include an elongated portion. The first inner surface, the second inner surface and the elongated portion can be covered. The pin can further include a contact surface that contacts a contact of the second connector. The first inner surface forcing the pin in the predetermined direction can cause the contact surface to slidably rotate against the contact of the second connector.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
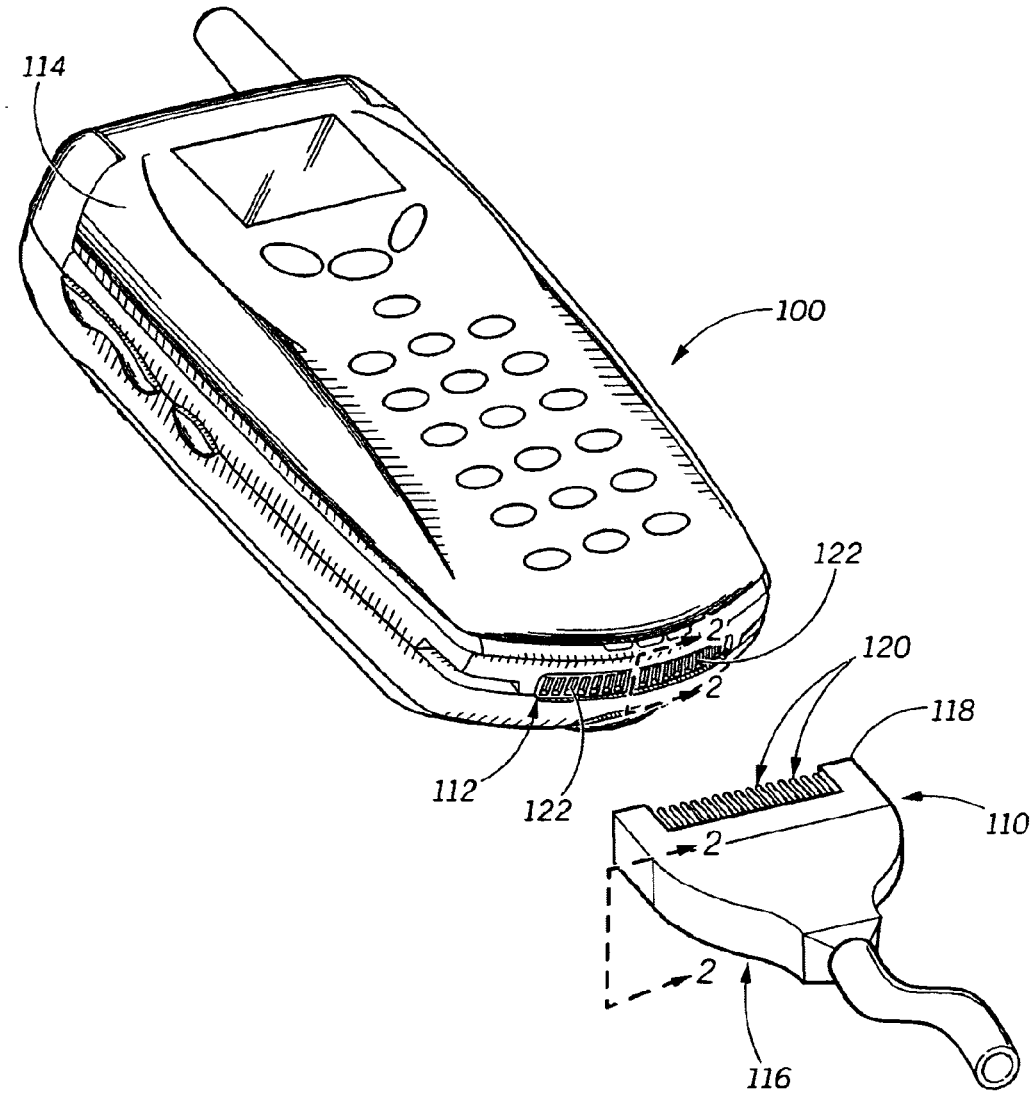
FIG. 1 illustrates an accessory connector and a connector of an electronic device in accordance with the inventive arrangements.

While the specification concludes with claims defining the features of the invention that are regarded as novel, it is believed that the invention will be better understood from a consideration of the following description in conjunction with the drawing figures, in which like reference numerals are carried forward.

Referring to FIG. 1, a system 100 for cleaning contacts of corresponding connectors is shown. The system 100 can include a first connector 110 and a second connector 112 in which the first connector 110 and the second connector 112 can engage one another. As an example, the first connector 110 can be an accessory connector, such as a charger, and the second connector 112 can be part of an electronic device 114, such as a cellular telephone. It is understood, however, that the invention is not limited to this particular example, as the first connector 110 and the second connector 112 can be part of other suitable devices.

The first connector 110 can include a body 116 having a head 118. The head 118 can fit substantially within the second connector 112, which can permit the first connector 110 to engage the second connector 112. The first connector 110 can also include at least one pin 120. Additionally, the second connector 112 can include at least one contact 122, each of which can correspond to a pin 120 of the first connector 110. As an example, when the head 118 of the first connector 110 is inserted in the second connector 112, the pins 120 of the first connector 110 can contact the contacts 122, which, for example, can create a path for charging current to flow.

Figure 2:
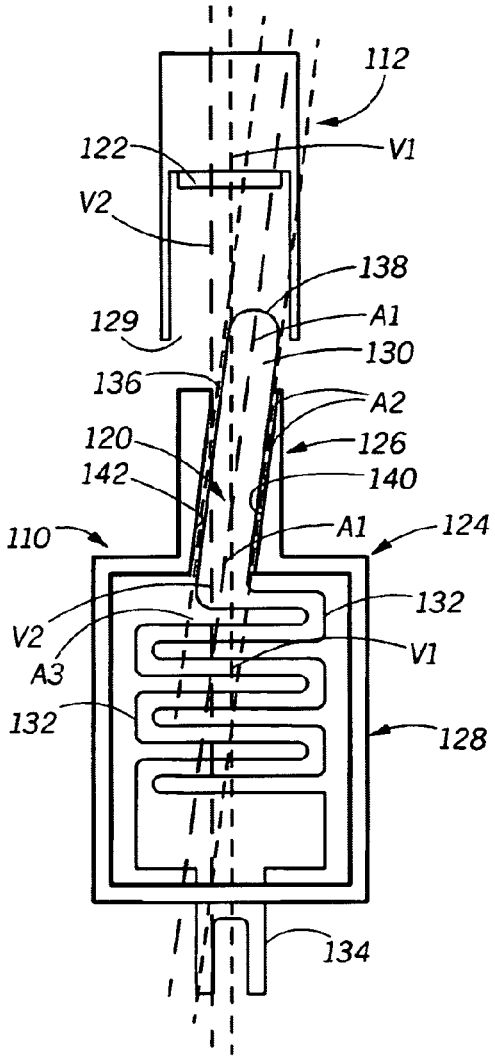
FIG. 2 illustrates a cross-sectional view taken along reference lines 2—2 of the accessory connector and the connector of the electronic device of FIG. 1 in accordance with the inventive arrangements.

Referring to FIG. 2, cross-sectional views of examples of the first connector 110 and the second connector 112 looking along reference lines 22 of FIG. 1 are shown. The first connector 110 can include at least one tunnel 124 having a first portion 126 and a second portion 128, and at least a portion of the pin 120 can be positioned within the tunnel 124. The body 116 (see FIG. 1) of the first connector 110 can include a plurality of these tunnels 124, each of which can house a pin 120. The pin 120 can include an elongated portion 130, a spring 132 and a fork 134, and the elongated portion 130 can be attached to the spring 132, which can be attached to the fork 134. In one arrangement, the elongated portion 130 can be at least substantially housed within the first portion 126 of the tunnel 124, and the spring 132 can be at least substantially housed within the second portion 128 of the tunnel 124. At least a portion of the elongated portion 130 can extend beyond an opening 136 of the first portion 126 of the tunnel 124. Additionally, the fork 134 can extend beyond an opening (not shown) of the second portion 128, and the fork 134 can be coupled to, for example, a bus (not shown) or some other electrical component. The second connector 112 can also have an opening 129 for receiving the first portion 126 of the tunnel 124.

The elongated portion 130 of the pin 120 can have a contact surface 138, which, when the first connector 110 is engaged with the second connector 112, can contact the corresponding contact 122. When the contact surface 138 contacts the contact 122, the elongated portion 130 can be forced downward in view of the flexibility of the spring 132. During this process, contaminants can be removed or wiped from the pin 120, the contact 122 or a combination thereof, an operation that will be described below.

The pin 120 can have a vertical axis $V_1$, and the tunnel 124 can have a vertical axis $V_2$. In one arrangement, the elongated portion 130 of the pin 120 can extend from the spring 132 along an axis $A_1$ that is at a predetermined angle with respect to the vertical axis $V_1$. Further, the first portion 126 of the tunnel 124 can include a first inner surface 140 and a second inner surface 142. In another arrangement, the first inner surface 140 can run along an axis $A_2$ that is at a predetermined angle with respect to the vertical axis $V_2$ of the tunnel 124. Additionally, the second inner surface 142 can be opposed to or opposite of the first inner surface 140 in which the second inner surface runs along an axis $A_3$ that is at a predetermined angle with respect to the vertical axis $V_2$ of the tunnel 124. As an example, the predetermined angle of the axis $A_3$ can at least substantially match the predetermined angle of the axis $A_2$. In other words, the axis $A_2$ can be at least substantially parallel to the axis $A_3$.

Figure 3:
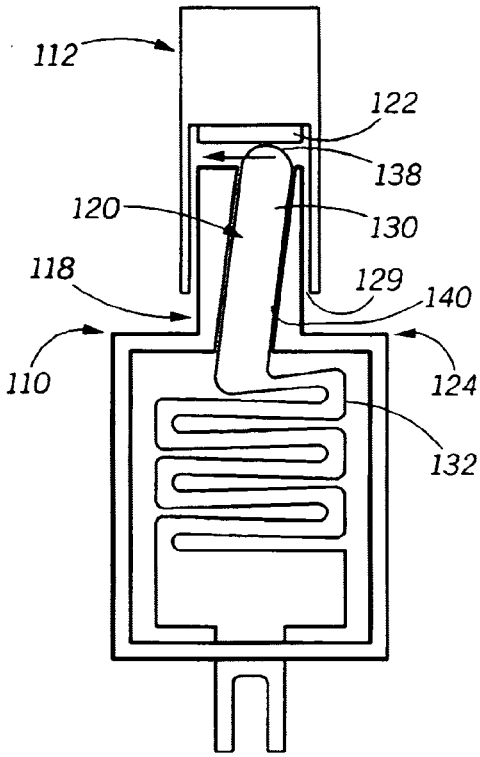
FIG. 3 illustrates the accessory connector of FIG. 2 engaged with the connector of the electronic device of FIG. 2 in accordance with the inventive arrangements.

As noted earlier, the first connector 110 and the second connector 112 can engage one another. Referring to FIG. 3, cross-sectional views of the first connector 110 and the second connector 112 looking along reference lines 2—2 of FIG. 1 in which the first connector 110 is engaged with the second connector 112 are shown. The head 118 of the first connector 110 (see also FIG. 1) can be inserted in the second connector 112, and the first portion 126 of the tunnel 124 of FIG. 3 can move through the opening 129 of the second connector 112. As the first connector 110 engages the second connector 112, the contact surface 138 of the pin 120 can contact the contact 122 of the second connector 112.

Because they are exposed to the outside environment, dirt or other contaminants may collect on the contact surface 138 of the pin 120 or the contact 122. In accordance with the inventive arrangements, however, these contaminants may be at least partially removed from either of the contact surface 138 or the contact 122 as the first connector 110 is engaged with the second connector 112. For example, as the contact surface 138 contacts the contact 122, the contact 122 can force the pin 120, in view of the flexibility of the spring 132, in a downward direction. As the pin 120 moves downward, the elongated portion 130 can be forced against the first inner surface 140. As a result, the first inner surface 140 can force at least a portion of the elongated portion 130 of the pin 120 to move in at least a first predetermined direction. As an example, the first inner surface 140 can force the elongated portion 130 to move in a direction that is at least substantially in accordance with the direction shown in FIG. 3. As a result of this movement, the contact surface 138 can slide along the contact 122. Any contaminants that may be present on the contact surface 138 or the contact 122 can be scraped or wiped away from these components, which can improve their performance.

Figure 4:
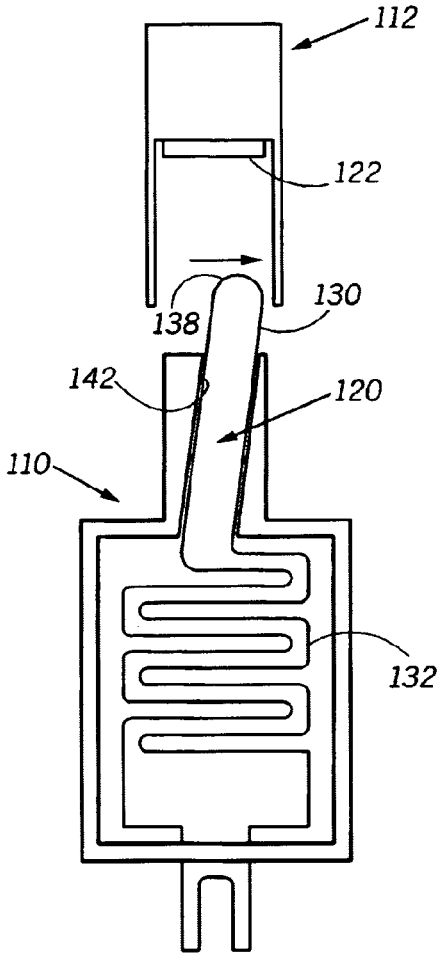
FIG. 4 illustrates the accessory connector of FIG. 2 disengaged from the connector of the electronic device of FIG. 2 in accordance with the inventive arrangements.

When the first connector 110 is removed or disengaged from the second connector 112, spring 132 of the pin 120 can decompress. Referring to FIG. 4, in response, the second inner surface 142 can then force at least a portion of the elongated portion 130 of the pin 120 in at least a second predetermined direction. As an example, the second inner surface 142 can force the elongated portion 130 to move in a direction that is at least substantially in accordance with the direction shown in FIG. 4. Any contaminants that may be on the contacts surface 138 or the contact 122 may also be scraped away. This subsequent cleaning step can supplement the removal of contaminants that is described above. In one arrangement, the second predetermined direction can be at least substantially opposite to the first predetermined direction.

It is important to note that the invention is not limited to the particular design that is illustrated in the drawings. For example, the axes along which the elongated portion 130, the first inner surface 140 and the second inner surface 142 run can be at any other suitable predetermined angle with respect to the vertical axes $V_1$ and $V_2$. Moreover, it is contemplated that the elongated portion 130 can move in directions other than the directions illustrated in FIGS. 3 and 4 for purposes of removing any contaminants.

Figure 5:
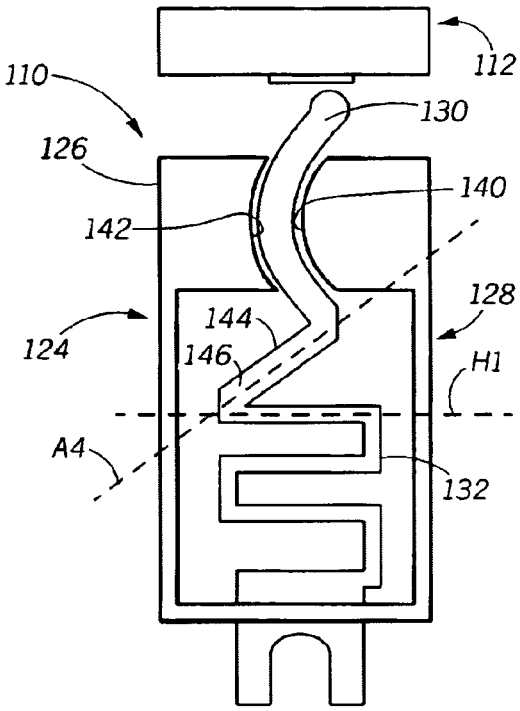
FIG. 5 illustrates a cross-sectional view of another example of the accessory connector and the connector of the electrical device of FIG. 1 taken along reference lines 2—2 in accordance with the inventive arrangements.

Referring to FIG. 5, cross-sectional views of another example of the first connector 110 and the second connector 112 are shown. In this example, similar to the embodiments described in relation to FIGS. 2–4, at least a portion of the pin 120 can be positioned within the tunnel 124. Here, at least a portion of the elongated portion 130 of the pin 120 can be curved. The curved elongated portion 130 can be positioned within the first portion 126 of the tunnel 124. In addition, the pin 120 can include a horizontal axis $H_1$ and a segment 144, which can be attached to the elongated portion 130 and the spring 132. The segment 144 can run at least substantially along an axis $A_4$ that is at a predetermined angle with respect to the horizontal axis $H_1$. Also, because of the flexibility of the pin 120, the location where the segment 144 attaches to the spring 132 can serve as a pivot point 146.

As shown in FIG. 5, the first inner surface 140 and the second inner surface 142 can be curved in which the second inner surface 142 is opposed to the first inner surface 140. In one particular arrangement, the shape of the first inner surface 140 and the second inner surface 142 can substantially match the curved elongated portion 130. It is understood, however, that the invention is not limited in this regard, as the first inner surface 140 and the second inner surface 142 can have any other suitable shape.

Figure 6:
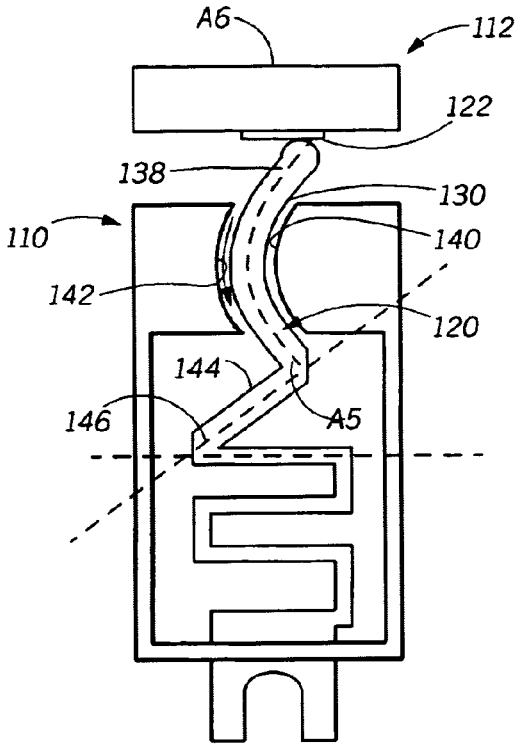
FIG. 6 illustrates the accessory connector of FIG. 5 engaged with the connector of the electrical device of FIG. 5 in accordance with the inventive arrangements.

As shown in FIG. 5, the first connector 110 and the second connector 112 are not engaged. As the first connector 110 is engaged with the second connector 112, the contact surface 138 of the pin 120 can contact the contact 122, as shown in FIG. 6. In response, the contact 122 can force the pin 120 in a downward direction, and the first inner surface 140 can force the curved elongated portion 130 of the pin 120 in at least a first predetermined direction. As an example, the first predetermined direction can be a curved direction that runs at least substantially along an arc $A_5$, which is also represented by the arrow in FIG. 6. In another arrangement, the second inner surface 142 can also force the curved elongated portion 130 of the pin 120 in the first predetermined direction. This force from the second inner surface 142 can be in lieu of or in combination with the force provided by the first inner surface 140. During this process, the curved elongated portion 130 can translate its force to the segment 144, which can pivot around the pivot point 146. This operation can assist in the movement of the curved elongated portion 130.

As the pin 120 is forced in the first predetermined direction, the contact surface 138 of the elongated portion 130 can slidably rotate against the contact 122 of the second connector 112. In particular, the contact surface 138 can slide across the contact 122, and in addition to this sliding action, because of the curvature of the elongated portion 130, the contact surface 138 can rotate or pivot along the contact 122. An arc $A_6$ can represent the portion of the contact surface 138 that slidably rotates against the contact 122. Of course, this arc $A_6$ is merely one example of the portion of the contact surface 138 that can slidably rotate against the contact 122 and is not 20 meant to limit the invention in any way. As the contact surface 138 slidably rotates against the contact 122, any contaminants on either the pin 120 or the contact 122 can be wiped or scraped away.

Figure 7:
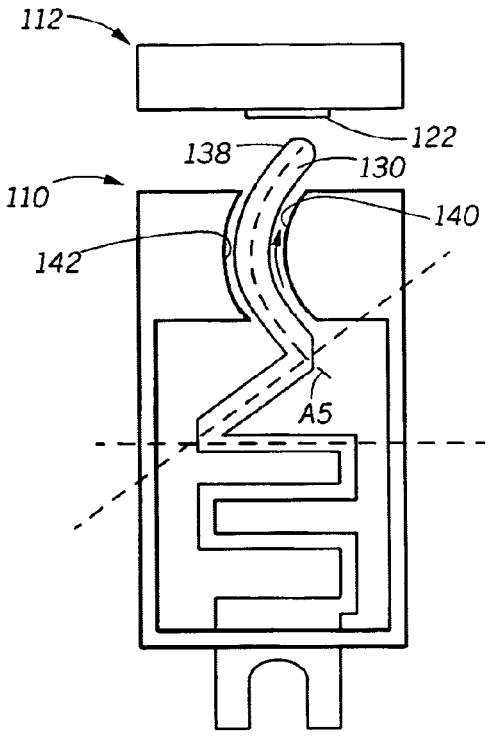
FIG. 7 illustrates the accessory connector of FIG. 5 disengaged from the connector of the electrical device of FIG. 5 in accordance with the inventive arrangements.

Referring to FIG. 7, the first connector 110 and the second connector 112 can be disengaged, and the first inner surface 140 and the second inner surface 142 can force the elongated portion 130 in a second predetermined direction. As an example, this second predetermined direction can be a curved direction that is opposite that of the first predetermined direction. That is, during the disengagement process, the elongated portion 130 of the pin 120 can move along the axis $A_5$ in accordance with the arrow shown in FIG. 7. In response, the contact surface 138 can slidably rotate back along the arc $A_6$. As a result, contaminants on either the pin 120 or the contact 122 can be removed when the first connector 110 disengages the second connector 112. It is understood, however, that the invention is in no way limited to the design illustrated in FIG. 5–7. In particular, the pin 120, the first inner surface 140 and the second inner surface 142 can have other suitable configurations.

In addition, while the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A connector, comprising:

at least one tunnel having a first portion and a second portion; and at least one pin, wherein at least a portion of said pin is positioned within said tunnel;

wherein said first portion of said tunnel has a first inner surface, wherein said first inner surface runs along an axis that is at a predetermined non-zero degree angle with respect to a vertical axis of said tunnel, wherein said first inner surface forces at least a portion of said pin to move along a portion of a corresponding connector in at least a first direction as said connector engages the corresponding connector, whereby contaminants are at least partially removed from at least one of said portion of said pin and the portion of the corresponding connector as said first inner surface forces said portion of said pin to move along the portion of the corresponding connector in said first direction.

2. The connector according to claim 1, wherein the portion of the corresponding connector includes a contact and said portion of said pin includes a contact surface that contacts the contact of the corresponding connector, wherein said first inner surface forcing said portion of said pin to move along the portion of the corresponding connector in said first direction causes said contact surface to slide against the contact of the corresponding connector, whereby the contaminants on at least one of said pin and the contact of the corresponding connector are at least partially removed from at least one of said pin and the contact of the corresponding connector as said contact surface slides against the contact of the corresponding connector.

3. The connector according to claim 1, wherein said pin includes an elongated portion, a fork and a spring, wherein said elongated portion is attached to said spring and said spring is attached to said fork.

4. The connector according to claim 3, wherein said elongated portion extends from said spring along an axis at a predetermined angle with respect to a vertical axis of said pin, wherein said predetermined angle of said axis that said elongated portion runs along at least substantially matches said predetermined non-zero angle of said axis that said first inner surface runs along.

5. The connector according to claim 1, wherein said first portion of said tunnel further includes a second inner surface opposed to said first inner surface, wherein said second inner surface runs along an axis that is at a predetermined angle that at least substantially matches said predetermined non-zero angle of said axis that said first inner surface runs along.

6. The connector according to claim 5, wherein said second inner surface forces at least the portion of said pin to move along the portion of the corresponding connector in a second direction as said connector disengages the corresponding connector.

7. The connector according to claim 6, wherein said second direction is at least substantially opposite to the first direction.

8. The connector according to claim 3, wherein said first portion houses said elongated portion of said pin and said second portion houses said spring of said pin.

9. The connector according to claim 1, further comprising a body, wherein said body includes a plurality of said tunnels and at least a portion of said pins extend beyond said tunnels, wherein said body includes a head that fits at least substantially within the corresponding connector.

10. The connector according to claim 1, wherein said connector is an accessory connector and the corresponding connector is mounted on an electronic device.

11. The connector according to claim 2, wherein said pin includes an elongated portion, a fork and a spring, wherein said elongated portion is attached to said spring and said spring is attached to said fork, wherein at least a portion of said elongated portion is curved.

12. The connector according to claim 11, wherein said elongated portion has a segment that runs along an axis that is at a predetermined angle with respect to a horizontal axis of said pin, wherein said segment is attached to said curved portion of said elongated portion and said spring.

13. The connector according to claim 12, wherein said first direction is a curved direction that runs along an arc thereby causing said contact surface of said pin to slidably rotate against the contact of the corresponding connector, whereby the contaminants on at least one of said pin and the contact of the corresponding connector are at least partially removed from at least one of said pin and the contact of the corresponding connector as said contact surface slidably rotates against the contact of the corresponding connector.

14. The connector according to claim 11, wherein said first portion of said tunnel further comprises a second inner surface opposed to said first inner surface, wherein said first inner surface and said second inner surface are curved, and wherein the shape of said first inner surface and said second inner surface substantially match said curved portion of said elongated portion.

15. The connector according to claim 14, wherein said second inner surface, in combination with said first inner surface, forces said pin to move in said first direction.

16. The connector according to claim 15, wherein said first inner surface and said second inner surface force said pin to move in a second direction, wherein said second direction is a curved direction that is opposite that of said first direction, wherein said second direction causes said contact surface of said pin to slidably rotate against the contact of the corresponding connector.

17. A system for cleaning contacts of corresponding connectors, comprising:

a first connector including at least one tunnel having a first portion and a second portion and at least one pin, wherein at least a portion of said pin is positioned within said tunnel; and a second connector;

wherein said first portion of said tunnel has a first inner surface, wherein said first inner surface runs along an axis that is at a predetermined non-zero degree angle with respect to a vertical axis of said tunnel, wherein said first inner surface forces at least a portion of said pin to move along a portion of said second connector in a first direction as said first connector is engaged with said second connector;

wherein contaminants on at least one of said portion of said pin and said portion of said second connector are at least partially removed as said first inner surface forces said portion of said pin to move along said portion of said second connector in said first direction.

18. The system according to claim 17, wherein said portion of said second connector includes a contact and said portion of said pin includes a contact surface that contacts said contact of said second connector, wherein said first inner surface forcing said portion of said pin to move along said portion of said second connector in said first direction causes said contact surface to slide against said contact of said second connector.

19. The system according to claim 17, wherein said tunnel further comprises a second inner surface and said pin includes an elongated portion, wherein said first inner surface, said second inner surface and said elongated portion are curved.

20. The system according to claim 19, wherein said portion of said second connector includes a contact and said portion of said pin further includes a contact surface that contacts said contact of said second connector, wherein said first inner surface forcing said portion of said pin to move along said portion of said second connector in said first direction causes said contact surface to slidably rotate against said contact of said second connector.

* * * * *